United States Patent [19]

Mori et al.

[11] 4,029,266

[45] June 14, 1977

[54] AUTOMATIC THREAD WINDING APPARATUS

[75] Inventors: Takashi Mori, Yamatokoriyama; Michio Kato, Hirakata; Koichi Mizu; Yoshikazu Nishida, both of Neyagawa, all of Japan

[73] Assignee: Matsushita Electric Industrial Co., Ltd., Kadoma, Japan

[22] Filed: Nov. 6, 1975

[21] Appl. No.: 629,782

Related U.S. Application Data

[63] Continuation-in-part of Ser. No. 435,575, Jan. 22, 1974, abandoned.

[30] Foreign Application Priority Data

| | | |
|---|---|---|
| Jan. 26, 1973 | Japan | 48-11447 |
| Jan. 26, 1973 | Japan | 48-11452 |
| June 15, 1973 | Japan | 48-68050 |
| June 15, 1973 | Japan | 48-68052 |
| Dec. 20, 1973 | Japan | 48-2778 |

[52] U.S. Cl. ..... 242/20; 242/21; 242/23

[51] Int. Cl.[2] ..... B65H 54/00

[58] Field of Search ..... 242/20, 21, 22, 23, 242/24, 18 R, 18 A, 16, 17, 25 R

[56] References Cited

UNITED STATES PATENTS

| | | | |
|---|---|---|---|
| 495,990 | 4/1893 | Muller | 242/21 |
| 1,430,079 | 9/1922 | Herr | 242/18 R |
| 1,440,295 | 12/1922 | Herr | 242/18 A |
| 1,499,925 | 7/1924 | Herr | 242/20 |
| 2,815,178 | 12/1957 | Cone | 42/23 |

FOREIGN PATENTS OR APPLICATIONS

| | | | |
|---|---|---|---|
| 71,448 | 1/1916 | Switzerland | 242/23 |

*Primary Examiner*—Stanley N. Gilreath
*Attorney, Agent, or Firm*—Wenderoth, Lind & Ponack

[57] ABSTRACT pg,1 An automatic thread winding apparatus for automatically winding thread on a plurality of double-flanged bobbins of a type for use in sewing machines. The apparatus includes a bobbin supply unit for supplying bobbins in an arbitrary manner and in a row onto a thread winding unit. The bobbins in a row are successively transferred, one at a time, to the thread winding unit by a shuttling mechanism. Thread winding takes place while each one of the empty bobbins are firmly held between a tailstock and a headstock. The bobbin after having been wound with a predetermined quantity of thread is subsequently doffed onto a temporary storage mechanism wherein cutting of a portion of the thread extending between the filled bobbin and the temporary storage mechanism takes place. All of these processes are timed and sequentially performed by various cam mechanisms.

9 Claims, 21 Drawing Figures

AUTOMATIC THREAD WINDING APPARATUS

BACKGROUND OF THE INVENTION

This application is a continuation-in-part of our copending application Serial No. 435,575, filed on January 22, 1974, now abandoned.

The present invention relates to an apparatus for automatically and cyclically winding thread on bobbins of a type generally utilized in association with sewing machines.

More particularly, the present invention relates to the thread winding apparatus that is capable of sequentially operating in a manner for automatically positioning each one of a plurality of empty bobbins, that are successively fed from a bobbin supply unit onto a thread winding unit, between rotatable spindles of the thread winding unit, automatically positioning the thread on the empty bobbin in readiness for the winding operation, automatically winding the thread on the empty bobbin in a predetermined quantity and at a predetermined density, automatically doffing the filled bobbin from the winding unit onto a thread severing unit and positioning a new empty bobbin to be wound in the winding unit as the filled bobbin is removed from the thread severing unit into a suitable storage receptacle or container.

A bobbin employed in association with a sewing machine is generally constructed with a cylindrical body having both end extremities rigidly mounted, or otherwise integrally formed, with annular flanges, representing a substantially H-shaped configuration as viewed in a direction perpendicular to the longitudinal axis of the cylindrical body. Because of the particular configuration, automatic winding of thread on sewing machine bobbins of the above construction has been long considered difficult with the exception of a machine of a similar kind disclosed in the U.S. Pat. No. 2,815,178, patented on Dec. 3, 1957.

The thread winding machine of the abovenumbered U.S. Pat. is, in fact, advantageous in that a plurality of sewing machine bobbins can be wound simultaneously with the same color of thread or any one or groups of the bobbins can be wound with thread of a different color. Notwithstanding this feature, the thread winding machine now referred to may be reduced to an automatic winding machine for winding a single color of thread successively on sewing machine bobbins. However, this thread winding machine is employed in the form of a multi-thread winding device as disclosed in the abovenumbered U.S. Patent or in the form of a single thread winding device which can be deduced from the teachings of the same U.S. Patent, and this thread winding machine is complicated in construction and, above all, it employs combined hydraulic, electrical and mechanical drives to sequentially operate various machine mechanisms. This leads to various disadvantages in that maintenance of the machine requires relatively high costs and is not so easy as to facilitate constant quality of the performance and efficiency of the machine throughout its life time, in that the machine itself is so bulky as to require a relatively large space for installation and in that the machine is too expensive.

SUMMARY OF THE INVENTION

Accordingly, an essential object of the present invention is to provide a thread winding apparatus capable of efficiently and effectively operating the various steps of process in an automatic and sequential manner, as described above, with substantial elimination of the disadvantages inherent in the conventional machine of a similar kind.

Another important object of the present invention is to provide a thread winding apparatus of the type referred to above, wherein only electrical and mechanical drives are employed for sequentially operating various machine mechanisms to successively fill empty bobbins, the electrical drive being solely composed of an electrically operated motor and associated switches.

A further object of the present invention is to provide a thread winding apparatus of the type referred to above, which is simplified in construction and compact in size so that maintenance of the machine is inexpensive and which can be manufactured at low costs.

A still further object of the present invention is to provide a thread winding apparatus of the type referred to above, wherein all the various parts of the machine are assembled above a caster-wheeled bench whereby the machine can be moved from one place to another without requiring a fixed space for installation.

According to the present invention, the thread winding apparatus includes a bobbin supply unit which comprises a stationary container and a substantially bevel-shaped rotatable dish of a diameter substantially equal to the inner diameter of the stationary container, said rotatable dish being accommodated within said container and operatively coupled to a motor. The stationary container has an upright wall substantially surrounding the periphery of the rotatable dish and the wall having therein a supply opening which is connected with a shuttling mechanism through a chute made of a pair of spaced wires. A plurality of sewing machine bobbins are arbitrarily supplied into the container and onto the rotatable dish within said container and, as the rotatable dish is rotated in one direction, the empty bobbins are successively expelled through the supply opening under the influence of a centrifugal force and then onto the wire chute through which the empty bobbins are downwardly guided by gravity towards the shuttling mechanism.

The shuttling mechanism acts to transfer each one of the empty bobbins from the wire chute to a thread winding unit after the preceding bobbin has been wound with a predetermined quantity of thread and at a predetermined density.

The thread winding unit basically comprises a pair of axially movable and stationary spindles, both having opposed ends rigidly mounted with respective retaining blocks and being rotatable about their own axes, one of these spindles being operatively coupled to a motor. The axially movable spindle can be moved close to the stationary spindle in a timed relation with respect to operation of the shuttling mechanism, i.e., immediately after the empty bobbin has been transferred to the thread winding unit, and at the time of completion of such transference, the empty bobbin is firmly held in position sandwiched between the retaining blocks on the axially movable and stationary spindles in readiness for the winding operation.

The full bobbin that has been wound with a predetermined length of thread is subsequently supplied by its own gravity onto the thread severing unit which may be in the form of either a mechanical cutter or an electrical burner heater. This takes place when the axially movable spindle moves away from the stationary spindle with the retaining block on the axially movable spindle releasing the thread-filled bobbin and severing of the thread takes place when the axially movable spindle is subsequently moved again close to the stationary spindle to hold the following empty bobbin between the retaining blocks.

After the severing operation, the full bobbin is doffed from the severing unit onto a suitable storage receptacle in which it is temporarily stored in the form of the finished thread package in readiness, for example, for boxing for shipment.

BRIEF DESCRIPTION OF THE DRAWINGS

These and other objects and features of the present invention will more readily become apparent from the following description taken in conjunction with preferred embodiments thereof with reference to the accompanying drawings, in which.

DETAILED DESCRIPTION OF THE INVENTION

Figure 1:
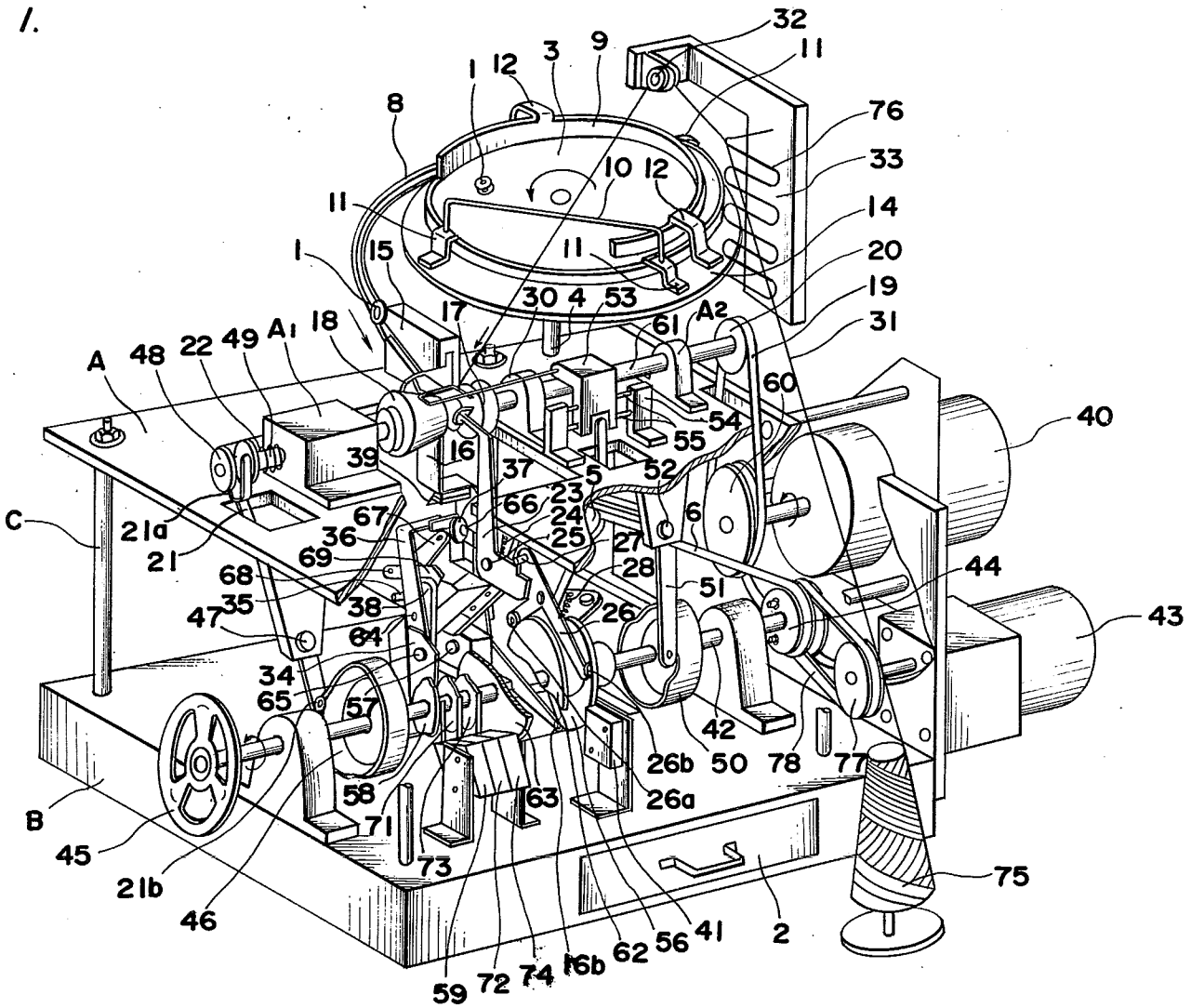
FIG. 1 is a schematic perspective view of a thread winding apparatus according to the present invention, with portions being cut away to show the details of interconnection of various movable parts thereof.

Before the description of the present invention proceeds, it should be noted that like parts are designated by like reference numerals throughout the accompanying drawings.

Referring to the drawings, the thread winding apparatus according to the present invention is constructed so that a plurality of sewing machine bobbins 1, each having a cylindrical body 1*a* and a pair of opposed annular flanges 1*b* secured to, or otherwise integrally formed with, respective ends of said cylindrical body 1*a*, are successively fed from a bobbin supply unit to a suitable storage receptacle 2 through a thread winding unit wherein the bobbins are wound, one at a time, with a predetermined quantity of thread and under a predetermined density.

Referring particularly to FIGS. 1 to 4, the bobbin supply unit is supported above a stationary platform A which constitutes a machine framework together with a boxlike base B spaced therefrom by means of a plurality of suitable spacers such as indicated by C and detachably accommodating therein the storage receptacle 2.

The bobbin supply unit comprises a tubular support 4 having one end rigidly mounted on the stationary platform A and the other end having rigidly mounted thereon a flat disc 14, a substantially bevel-shaped dish 3 and a substantially semi-circularly curved guide 9 which substantially spirally extends above said dish 3 adjacent and inside the peripheral edge of said dish 3. A shaft 4*a* (FIG. 4) extends through the tubular support 4 and has one end rigidly connected with the dish 3 and the other end operatively coupled to an electric motor 43 in a manner as will be described later, whereby operation of the motor 43 causes the shaft 4*a* to rotate the dish 3 about the axis of said shaft 4*a*.

The bobbin supply unit further comprises a chute, generally indicated by 8, which is composed of a pair of guide wires having respective lower ends terminating at a shuttling mechanism 15 as will be described later. One of the guide wires forming the chute 8 has a wire extension 7 extending above the dish 3 and along the peripheral edge of said dish, spaced therefrom a distance corresponding to half the length of the cylindrical body 1*a* of the bobbin 1 and outside the curved guide 9. The wire extension 7 terminates at a leading end of the curved guide 9 with respect to the direction of rotation of the dish 3 as indicated by the arrow and rigidly connected thereto.

The other of the guide wires forming the chute 8, but not having the wire extension 7, is rigidly secured, such as by welding, to the leading end of the curved guide 9 together with the free end of said wire extension 7. It is to be noted that the trailing end of the guide 9 opposed to said leading end is spaced as at 13 from a substantially intermediate portion of the wire extension 7 thereby providing a feed port leading to the chute 8.

The wire extension 7 and curved guide 9 are supported in position in the manner as hereinbefore described through a plurality of fixtures 11 and 12.

The bobbin supply unit further includes a barrier for positively throwing down to the surface of the dish 3 some of the bobbins which are positioned on the dish 3 with both of the flanges 1*b* lying at right angles to the surface of the dish 3, so that either of the opposed flanges 1*b* can lie flat on the surface of the dish 3 with the longitudinal axis of the cylindrical body 1*a* extending at right angles to said surface of said rotatable dish 3. The barrier simply comprises a rod 10 having both ends bent at right angles to the body of said rod 10 and rigidly secured to the two adjacent fixtures 11 as shown, while the body of said rod 10 partially bridges the rotatable dish 3. It is to be noted that the connection between each fixture 11 and the wire extension 7 should be carefully made so as not to form any projection which may otherwise hamper the smooth travel of each of the bobbins 1 along said wire extension 7.

In this arrangement, during rotation of the dish 3, a plurality of empty bobbins 1 arbitrarily placed on the rotatable dish 3 are outwardly expelled by centrifugal force, downwardly sliding on said dish 3 towards the guide 9 while angularly moving about the center of said dish 3. Since the centrifugal force still acts on each of the bobbins 1 during rotation of said dish 3, they can be successively expelled onto the chute 8 through the feed port 13 defined between the end of the guide 9 and the intermediate portion of the wire extension 7. Each bobbin thus supplied onto the chute 8 is downwardly guided by its own gravity towards the shuttling mechanism 15 in such a manner that the cylindrical body 1*a* of the bobbin 1 slides and/or rolls within the space between the guide wires that form the chute 8, while the uppermost flange 1*b* thereof slides on the wires.

In any event, the chute 8 should be adjusted, e.g., by twisting the wires, so that they, at the time of arrival of each empty bobbin at the shuttling mechanism 15, the bobbin 1 can assume a predetermined posture in such a manner that the cylindrical body 1*a* thereof extend horizontally while the flanges 1*b* thereof extend vertically.

Figure 2:
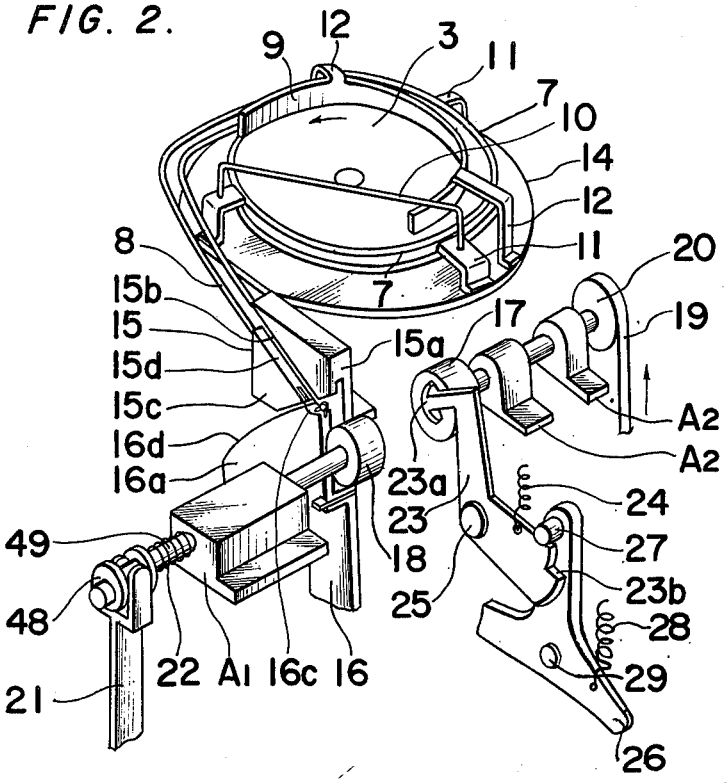
FIG. 2 is a schematic perspective view of a portion of the bobbin supply unit and a portion of the thread winding unit, both employed in the apparatus of FIG. 1.
Figure 3:
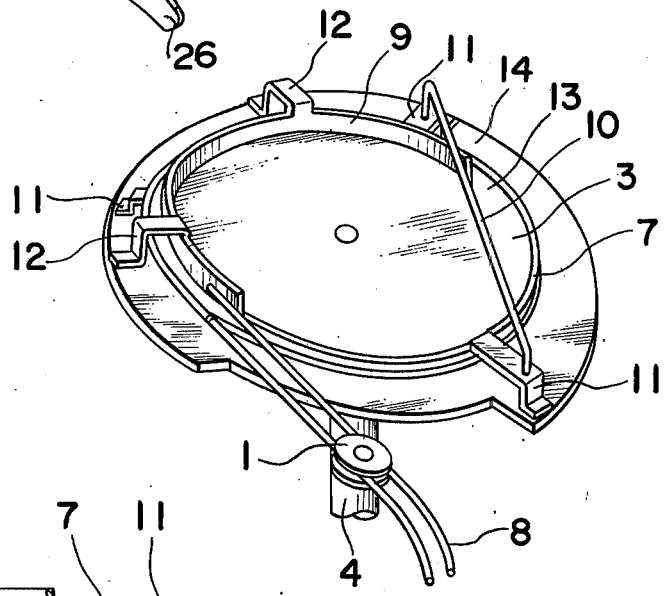
FIG. 3 is a schematic perspective view of a portion of the bobbin supply unit shown in FIG. 2, showing the details thereof.
Figure 4:
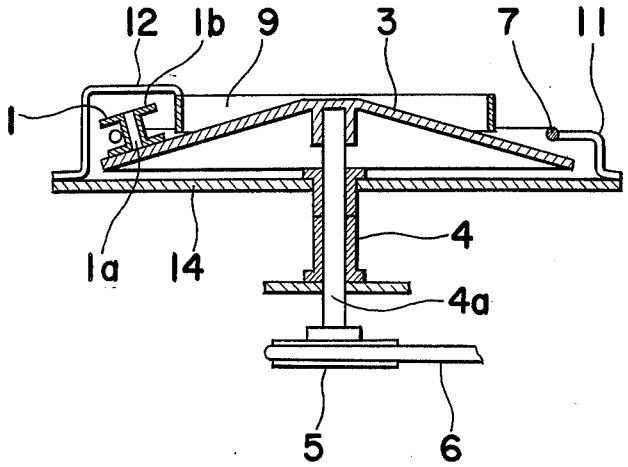
FIG. 4 is a side sectional view of a portion of the bobbin supply unit shown in FIG. 2.
Figure 19:
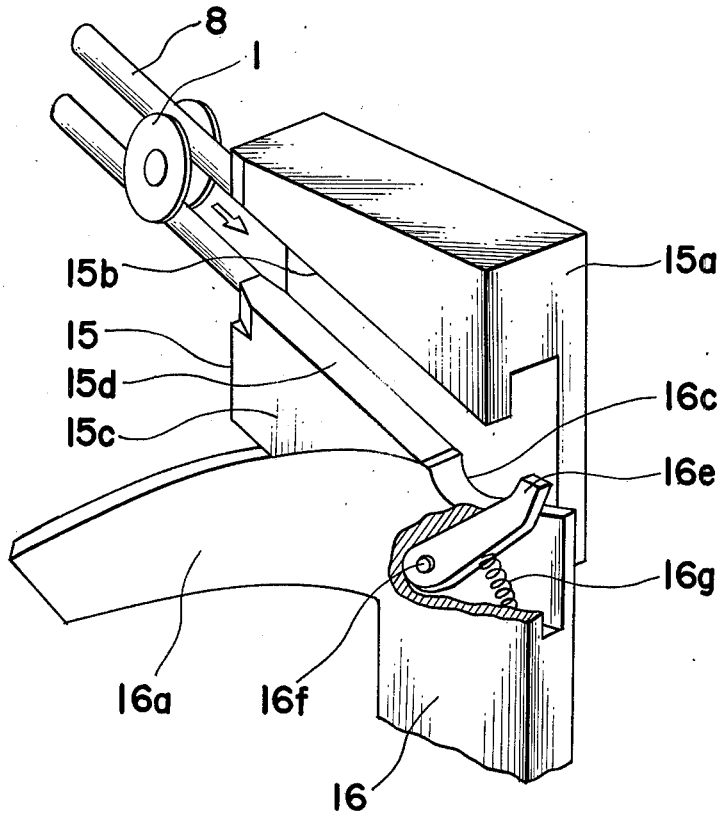
FIG. 19 is a perspective view, on an enlarged scale, of an essential portion of the shuttling mechanism employed in the apparatus of FIG. 1, with a portion bring broken away to show the details thereof.

The shuttling mechanism 15 as best shown in FIGS. 1, 2 and 19, comprises a ceiling block 15*a* rigidly supported above the platform A and having a downwardly inclined ceiling surface 15*b*, a slide block 15*c* rigidly secured to the platform A or the ceiling block 15*a* and having a downwardly inclined slide surface 15*d* immediately below and equally spaced from the ceiling surface 15*b* of the ceiling block 15, and a pivotal lever 16 pivotally supported as at 57 within the space between the platform A and the box-like base B and having on one end an integrally formed transfer segment 16*a* and on the other end a rotatably mounted roller element 16*b*. As shown, at the rear of the shuttling mechanism 15, the wires forming the chute 8 are respectively connected to the ceiling and slide blocks 15*a* and 15*c* so that each bobbin 1 rolling along the chute 8 can move onto the slide block 15*c* while straddling the slide surface 15*d* with the flanges 1*b* situated on opposite sides of said slide block 15*c*.

Adjacent the roller element 16*b*, a cam support shaft 42 having portions adjacent to both ends thereof journalled in a pair of suitable bearing structures, which are mounted on the box-like base B, extends at right angles to the lengthwise direction of the pivotal lever 16. This shaft 42 has detachably or rigidly mounted on one end a manually operable handle wheel 45 and rigidly mounted on the other end a double-grooved pulley 44 which is coupled both to the pulley 5 on the dish rotating shaft 4*a* through an endless belt 6 and to a drive pulley 77 on the drive shaft of the motor 43 through an endless belt 78, whereby operation of the motor 43 causes the shaft 42 and the rotatable dish 3 to rotate about their own axes.

This cam support shaft 42 carries thereon a first cam disc 56, against the periphery of which the roller element 16*b* on the pivotal lever 16 is constantly engaged. For this purpose, the pivotal lever 16 is so biased about the pivot 57 by a spring element (not shown) as to force the roller element 16*b* to contact the periphery of the cam disc 56. This first cam disc 56 is designed such that, during each 360° rotation of the cam disc 56 accompaning the rotation of the shaft 42, the transfer segment 16*a* angularly moves or reciprocates between stand-by and delivery positions while the lever 16 pivots about the pivot 57. The angular reciprocating movement of the transfer segment 16*a* is not continuous, but takes place in such a way that, as will be more specifically discussed with reference to FIG. 15, the transfer segment 16*a* stays at the stand-by position and at the delivery position for different periods of time, respectively.

Hereinafter, the individual operative positions of the transfer segment 16*a* will be defined. FIGS. 1, 2 and 19 illustrate the situation in which the transfer segment 16*a* is in the stand-by position in which condition the front bobbin of a row of empty bobbins, some straddling over the slide surface 15*d* of the slide block 15*c* and the others resting on the chute 8, is seated in a seat formed as at 16*c* in the segment 16*a* and retained by a pawl 16*e* which is pivotably mounted by a pivot pin 16*f* on the segment 16*a*. For this purpose, the pawl 16*e* is biased counterclockwise, as viewed in FIG. 19, by a spring element 16*g* so that one end of said pawl 16*e* remote from the pivot pin projects outwardly projects from the seat 16*c* and, therefore, assumes such a position as to provide a stop relative to the front bobbin.

On the other hand, when the transfer segment 16*a* is in the delivery position, the front bobbin engaged in the seat 16*c* and retained by the pawl 16*e* in the predetermined posture is ready to be picked up in the thread winding unit as will become clear from the subsequent description while an empty bobbin next to the front bobbin already seated in the seat 16*c* is blocked above the slide surface 15*d* in contact with the rear, as at 16*d*, of the segment 16*a* opposed to the seat 16*c* and remote from the pawl 16*e*. During travel of the segment 16*a* between these two positions, the cylindrical body 1*a* of the bobbin 1 next to the front bobbin that has been seated in the seat 16*c* slidingly contacts the substantially arched crest of said segment 16*a* which corresponds to the uppermost end face of the pivotal lever 16, said seat 16*c* being formed at the front of said crest. It is to be noted that, when the bobbin is picked up in the thread winding unit, the pawl 16*e* pivots against the spring element 16*g* about the pivot pin 16*f* to allow the bobbin, which has been seated in the seat 16*c* and retained by the pawl 16*e*, to be separated from the seat 16*c*. This is possible because, as the segment 16*a* moves from the delivery position back to the stand-by position, the cylindrical body of the bobbin then retained between headstock and tailstock of the thread winding unit as will subsequently be described is engaged by the pawl 16*e* causing the latter to pivot against the spring element 16*g* so as to pass beneath the held bobbin.

Figure 6:
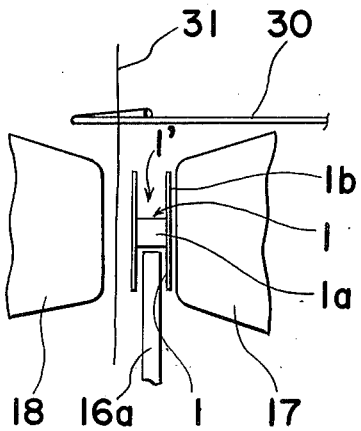
FIG. 6 is a schematic diagram showing how the empty bobbin is firmly held in position between a pair of retaining blocks while the thread end is simultaneously anchored to the empty bobbin.

The thread winding unit is best shown in FIGS. 1, 2 and 6 and reference to these drawings will now be made.

The thread winding unit essentially comprises a pair of axially movable and stationary spindles 49 and 61 aligned with respect to each other and each extending at right angles to the direction of movement of the transfer segment 16*a* above the platform A. The stationary spindle 61 has rigidly mounted on one end a cone-shaped headstock 17 and on the other end a pulley 20 which is in turn connected through an endless belt 19 to a drive pulley 60 on the drive shaft of another electric motor 40, a substantially intermediate portion of said spindle 61 rotatably extending through a plurality of spaced bearing blocks $A_2$on the platform A. One or all of these bearing blocks $A_2$ secured to the platform A should be understood as designed so as to rotatably support said spindle 61, but not to permit the spindle 61 to move axially.

The axially movable spindle 49 has rigidly mounted on one end a similarly cone-shaped tailstock 18 cooperative with the headstock 17, rigidly mounted on the other end a double flanged member 48 which functions as will become clear later, a substantially intermediate portion of which extends through and is supported by a bearing structure $A_1$ for axial and rotary movement. This movable spindle 49 is axially movable between release and hold positions and is normally biased to the release position, by a spring element, for example, a compression spring 22 mounted on the spindle 49 between the double flanged member 48 and the bearing structure $A_1$, with the tailstock 18 separated from the headstock 17 on the stationary spindle 61 a distance greater than the span between the flanges 1*b* of each bobbin 1.

The bobbin that has been transferred to the thread winding unit by the shuttling mechanism 15 with the segment 16*a* assuming the delivery position, can be picked up in said winding unit in such a manner that the bobbin is firmly sandwiched from both sides thereof by the cooperative headstock 17 and tailstock 18. In order to achieve this, i.e., in order to enable the movable spindle 49 to move to the hold position from the release position against the compression spring 22, an operating lever 21 and a first cam drum 46 are provided.

The operating lever 21 has one end formed into a double fork 21*a* engaged in the space between the opposed flanges of the double flanged member 48 for transmitting a pivotal movement of said lever 21 to said spindle 49. The other end of said operating lever 21 has thereon a roller element 21*b*, a substantially intermediate portion of which is pivotally connected as at 47 to a bracket downwardly extending from the platform A.

The roller element 21*b* is constantly engaged with the annular open end of the cam drum 46, which forms an annular cam ridge, by the action of the compression spring 22, said cam drum 46 being mounted on the cam support shaft 42 for rotation together therewith. Therefore, it has now become clear that rotation of the cam drum 46 causes the operating lever 21 to pivot about the pivot 47, which in turn causes the movable spindle 49 to move axially.

In the above arrangement, winding of thread 31 fed from a supply cone 75, which may be supported on a stand (not shown) extending from either the platform A or the base B, can be performed so long as the movable spindle 49 is in the hold position while the bobbin is firmly sandwiched between the headstock 17 and the tailstock 18 and, concurrently, the spindle 61 is driven by the motor 40. It should be noted that, during the actual winding operation, the rotation of the stationary spindle 61 is transmitted to the movable spindle 49 through the bobbin being wound and, therefore, the movable spindle 49 also rotates.

From the foregoing, it should be understood that the segment 16*a* of the pivotal lever 16, which forms a part of the shuttling mechanism 15, should be designed such as to permit the cylindrical body 1*a* of the bobbin to be aligned with the axes of the spindles 49 and 61 when said segment 16*a* is in the delivery position.

Figure 5:
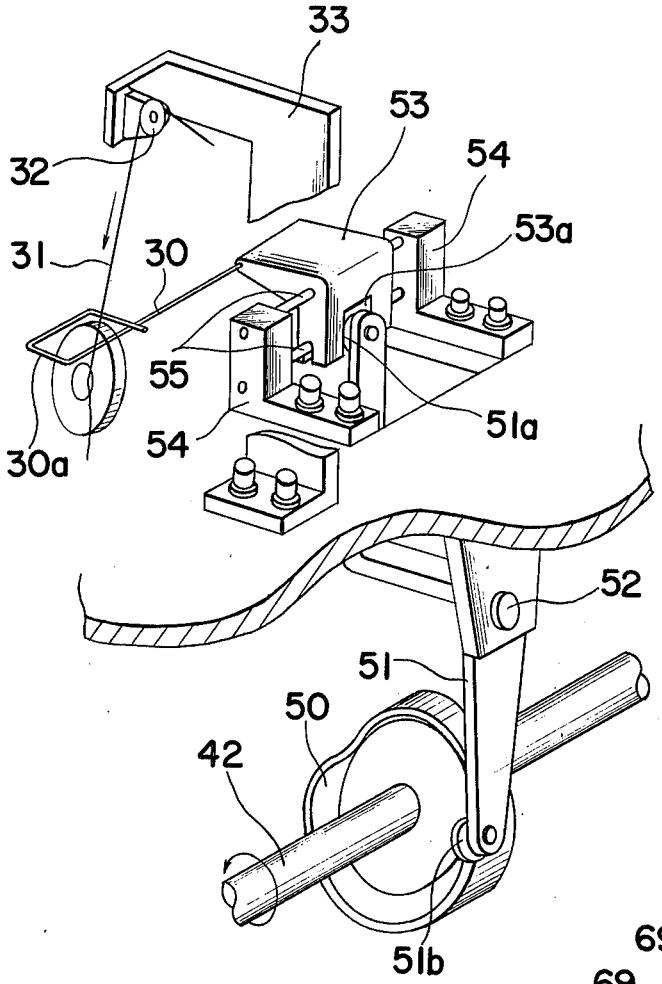
FIG. 5 is a schematic perspective view of another portion of the thread winding unit, showing a thread end anchoring mechanism for engaging a thread end to an empty bobbin preceding the winding operation.

The method employed in the winding unit of the construction shown in FIGS. 1, 2 and 6 for anchoring the leading end of the thread 31 to the empty bobbin held between the headstock 17 and the tailstock 18 will now be described with particular reference to FIGS. 1, 5 and 6.

Structurally speaking, in order to perform the anchoring method, an anchoring mechanism comprises a slidable block 53 slidable steadily in a direction parallel to the axial direction of the spindle 61 or 49 while being guided along a pair of spaced guide rods 55 each having both ends secured above an to the platform A through support blocks 54, respectively. An operating lever 51, pivotally connected as at 52 to a bracket which extends downwardly from the platform A, has mounted at both ends roller elements 51*a* and 51*b*; the roller element 51*a* being situated above the platform A and engaged in a recess 53*a* in the slidable block 53 for transmitting motion of the operating lever 51 to said block 53. The operating lever 51 is normally biased in one direction by a spring element (not shown) such as to constantly engage the roller element 51*b* with the cammed annular open end of a second cam drum 50 rigidly mounted on the cam support shaft 42. The cam drum 50 is designed such as to permit the slidable block 53 to reciprocatingly move between operative and inoperative positions during each 360° rotation thereof about the shaft 42.

The slidable block 53 includes a needle 30 having one end rigidly secured thereto by means of, for example A, pressure-fitting technique, and the other end substantially square-looped to provide a hook 30*a*, a substantially intermediate portion of which extends parallel to the direction of movement of the slidable block 53. The length of the needle 30 is selected so that when the slidable block 53 is in the inoperative position, the hook 30*a* is located immediately above the bobbin being wound and, when the slidable block 53 is in the operative position, the hook 30*a* is located substantially immediately above a space defined between the tailstock 18 and one of the bobbin flanges 1*b* adjacent said tailstock 18. The size of the hook 30*a* is preferably matched to that of the bobbin used.

As best shown in FIG. 6, assuming that the transfer segment 16*a* and the movable spindle 49 are respectively in the delivery and release positions, the leading end of the thread 31 passing through the hook 30*a* is left to extend loosely and downwardly by its own gravity between the tailstock 18 and one of the bobbin flanges 1*b* adjacent said tailstock 18, at which time the slidable block 53 is in the operative position. As the movable spindle 49 moves towards the bobbin to be wound, i.e., towards the hold position, the leading end of the thread 31 is sandwiched between the tailstock 18 and the flange 1*b* and, upon completion of travel of the movable spindle 49 to the hold position, the leading end of the thread 31 and the bobbin to be wound are both firmly sandwiched between said tailstock 18 and the headstock 17. The transfer segment 16*a* may subsequently return to the stand-by position leaving the transferred bobbin behind. In this way, anchoring of the thread end to the bobbin to be wound is completed. More specifically, rotation of the bobbin to be wound that takes place after the thread end anchoring has completed in this way results in winding of thread on the bobbin. Disengagement of the thread end from between the tailstock 18 and the bobbin flange 1*b* at the initial time of rotation of the bobbin does not occur since the thread end is firmly held in between said tailstock 18 and the bobbin flange 1*b*.

The slidable block 53 that has been moved to the operative position can be moved to the inoperative position after the thread end anchoring operation has been completed and before initiation of the rotation of the bobbin.

In the machine of the present invention, it is possible to interrupt the operation of the motor 40 each time the bobbin to be wound has been wound with a predetermined quantity of thread. For this purpose there is provided a detector mechanism which comprises, as best shown in FIGS. 1 and 2, a detecting lever 23 of substantially L-shaped configuration pivotally supported as at 25 by and below the platform A and having integrally formed on one end a feeler 23*a* engageable in between the bobbin flanges 1*b* and slidingly contactable with the thread being wound on the bobbin and the other end having therein a detent notch 23*b*. This detecting lever 23 is angularly movable about the pivot 25 between engaged and disengaged positions and is normally biased in one direction by a spring element 24 to the engaged position in which condition said feeler 23*a* is engaged in between the flanges 1*b* of the bobbin if the latter is held in position between the headstock 17 and the tailstock 18. The detecting mechanism includes a second cam disc 62 mounted on the cam support shaft 42, a substantially T-shaped intermediate lever 26 which is pivotally supported by and below the platform A as at 29, and a detector switch assembly 41.

The intermediate lever 26 has three end portions one of them having rigidly mounted thereon a pin 27, another one of them having rotatably mounted thereon a roller element 26*a*, and the remaining end portion forming an actuator 26*b*. This intermediate lever 26 is also biased about the pivot 29 in one direction by a spring element 28 with the roller element 26*a* being constantly in contact with the periphery of the second cam disc 62. At this time, depending upon the angular position of the cam disc 62, the pin 27 is either engaged in the detent notch 23*b* in the detecting lever 23 or disengaged from said detent notch 23*b* as shown in FIGS. 1 and 2. More specifically, the detecting lever 23 moves to the disengaged position only when the predetermined quantity of thread 31 is completely wound on the bobbin and when said detecting lever 23 is angularly moved to said disengaged position in this way, the pin 27 on the intermediate lever 26 tends to disengage from the detent notch 23*b*. When the pin 27 disengages from the detent notch 23*b* as shown, the detecting lever 23 can be held in the disengaged position. Return of the detecting lever 23 to the engaged position, i.e., engagement of the pin 27 in the detent notch 23*b*, can be achieved as the second cam disc 62 then rotating about the shaft 42 causes the intermediate lever 26 to pivot about the pivot 25 against the spring element 28 thereby permitting the detecting lever 23 to return to the engaged position by the action of the spring element 24 and then permitting the pin 27 to engage in the detent notch 23*b*.

The detector switch assembly 41 is designed such as to be operated by the actuator 26*b* on the intermediate lever 26 so as to supply electrical power to the motor 43 and, simultaneously therewith, to interrupt supply of electrical power to the motor 40. Therefore, it is clear that, when the bobbin has been fully wound with the thread, the motor 40 ceases to operate thereby to stop the winding operation and the motor 43 commences to operate to rotate the cam support shaft 42.

By designing the electrical control circuit for continuous operation, the motor 43 rotates even when the motor 40 is de-energized, and the switch 59 is actuated for starting the thread-winding operation again.

The cam disc 62 for the detector mechanism is designed in relation to the cam drum 46 such that, shortly after the bobbin has been fully wound with the thread and the detecting lever 23 has been angularly moved to the disengaged position, the spindle 49 can commence to move towards the released position thereby releasing the filled bobbin that has been held in position between the headstock 17 and the tailstock 18. The released, filled bobbin is then doffed down the space between the tailstock 18 and the head stock 17 by gravity and onto the thread serving unit situated substantially beneath the platform A.

Figure 8:
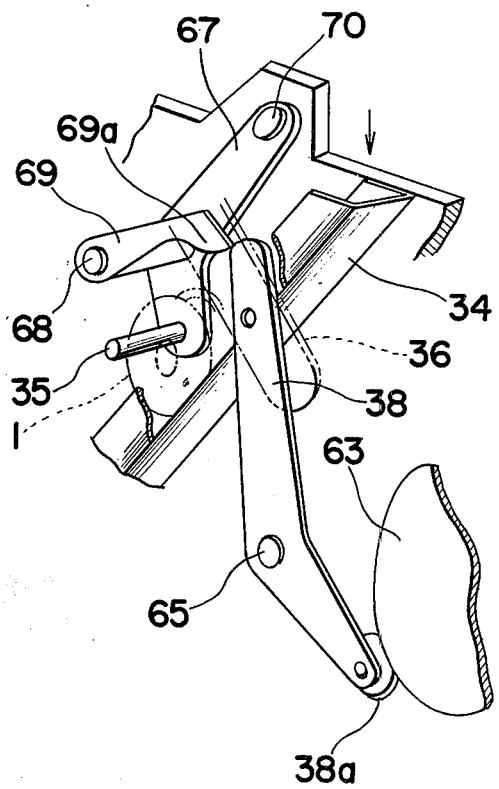
FIG. 8 is a schematic perspective view of a portion of a full bobbin doffing mechanism employed in the machine of the present invention.

The thread severing unit includes a temporary storage device in the form of a chute 34 (see FIG. 8) of a substantially channel-shaped section having one end situated immediately below the space between the headstock 17 and the tailstock 18 and the other end leading down to the storage receptacle 2. The filled bobbin doffed from the winding unit onto the thread severing unit is temporarily stored in this chute by the engagement with a stop 35 rigidly carried by a pivotally supported shuttering lever 67 having a construction as will be hereinafter described.

The shuttering lever 67 is pivotally secured as at 70 below and to the platform a and has mounted on a substantially intermediate portion a latch lever 69 in spaced relation to said lever 67. The latch lever 69 has one end pivotally mounted on the shuttering lever 67 by means of a spacer pin 68 and at the other end has an engagement 69*a*. A release lever 38 pivotally supported as at 65 extends between the engagement 69*a* and a third cam disc 63, mounted on the cam support shaft 42, and has one end in sliding contact with said engagement 69*a* of the latch lever 69 and has mounted on the other end mounted a roller element 38*a*. This release lever 38 is normally biased about the pivot 65 in one direction by a spring element (not shown) with said roller element 38*a* forced into contact with the periphery of said cam disc 63.

In the above arrangement the shuttering lever 67 is normally biased about the pivot 70 in one direction by a spring element (not shown) whereby the stop 35 is normally in position to hamper movement of the filled bobbin down the chute 34 onto the receptacle 2. It should be noted that the latch lever 69 is normally biased about the pin 68 by a spring element (not shown) in a direction counter to the biasing direction of the shuttering lever 67 so that the engagement 69*a* is forced to constantly contact the rounded end of the release lever 38.

The filled bobbin staying in the chute 34 in engagement with the stop 35 can be released to move down the chute 34 into the storage receptacle 2 when, during rotation of the cam disc 63, the release lever 38 pivots against the biasing spring element with the rounded end thereof pushing the latch lever 69 to pivot the shuttering lever 67 about the pivot 70 against the spring element. As the shuttering lever 67 is thus pivoted, the stop 35 disengages from the filled bobbin in the chute 34 thereby permitting the bobbin to be dropped downwardly by gravity.

It may be convenient if that portion of the thread extending between the filled bobbin then resting in the chute 34 and the thread supply cone 75 is slackened during thread cutting. To avoid this, the thread severing unit further includes a retainer, which cooperates with a tension control 32 (FIG. 1) of any known construction during actual thread cutting. This retainer (FIG. 7) comprises an abutment 37 which has a stud 37*a* supported in position by a block 37*b* for axial movement through a limited distance and a compression spring 66 for outwardly biasing said abutment 37. The block 37*b* is rigidly secured to the shuttling lever 16 below a cutter blade 39 which is also rigidly carried by said lever 16. A presser piece 36*a* engageable with the abutment 37 to hold the thread between it and said engagement 37 is carried by a support lever 36 which is mounted on the release lever 38 by means of an adjustment bolt 64 which extends through a slot 36*b* formed in said lever 36. The arrangement of the slot 36*b* and bolt 64 facilitates manual adjustment of the position of the presser piece 36*a* relative to the abutment 37 and also of the contact pressure between the piece 36*a* and the abutment 37.

Although it has now become clear that rotation of the cam disc 63 causes the presser piece 36*a* to engage with the abutment 37 with the thread held therebetween if the filled bobbin stays in the chute 34 and cutting is carried out by the pivotal movement of the shuttling lever 16, the actual cutting operation is in practice timed with the operation of the thread anchoring device in such a way as to occur only when the slidable block 53 is in the operative position and during the pivotal movement of the shuttling lever 16 from the hold position to the stand-by position. At this time, a portion of the thread between the retainer of the above construction and the tension control 32 is held under tension whereby no slackening of the thread takes place during the actual thread cutting.

It should be noted that engagement of the presser piece 36*a* with the abutment 37 to hold that portion of the thread takes place shortly after the filled bobbin has been released from the winding unit and disengagement of the stop 35 from the filled bobbin in the chute 34 takes place at the same time or shortly before the shuttling lever 16 completes its return movement to the stand-by position. This is possible by suitably selecting the design and position of the cam disc 63.

Figure 17:
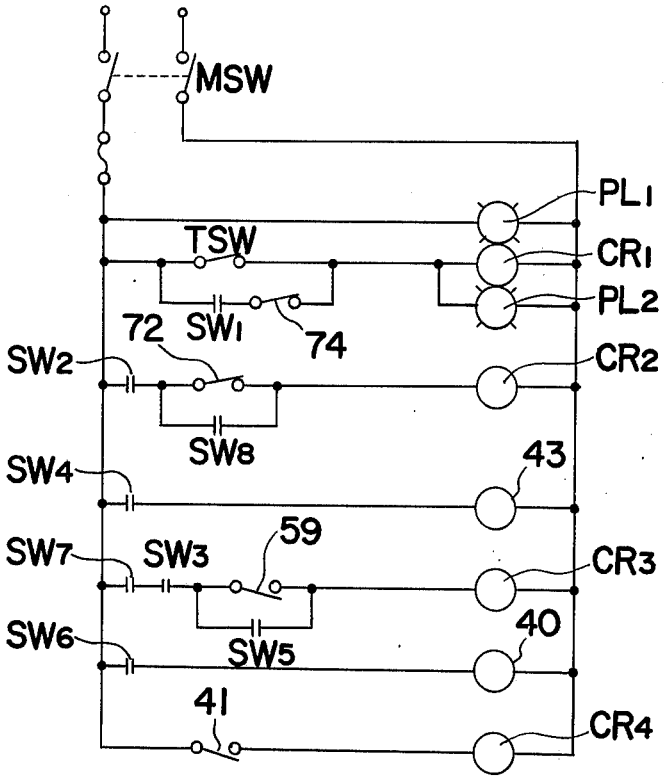
FIG. 17 is an electrical circuit diagram showing the electric circuit employed in the machine of the present invention.

Hereinafter, the operation of the machine of the construction so far described will be described and it will become clear how the various operating mechanism are sequentially timed in operation with respect to each other. For facilitating a better understanding thereof, in the following description, FIGS. 15 and 17 are taken into consideration which repectively illustrate shapes of the employed cams developed in a plane with respect to the 360° rotation of the cam support shaft 42 and an electrical circuit diagram of th circuit employed in the machine.

Assuming that a double-throw main switch MSW is closed and, subsequently or simultaneously therewith, a toggle switch TSW is closed, and a relay CR1 is energized to close relay switches SW1, SW2 and SW3 associated with said relay CR1. Lamp PL2 is also energized when the switch TSW is turned on, and de-energized when the switch TSW is turned off upon completion of one cycle during operation. Again assuming that disc cams 71 and 73 rigidly mounted on the cam support shaft 42 are both in position to close associated switches 72 and 74, the rely CR1 maintains the energized state and a relay CR2 becomes energized, respectively.

Upon energization of the relay CR2, a relay switch SW4 associated therewith is closed to operate the motor 43 and the cam support shaft 42 and the dish rotating shaft 4*a* are therefore rotated. Closure of the relay switch SW4 is maintained during energization of the relay Cr2.

Figure 15:
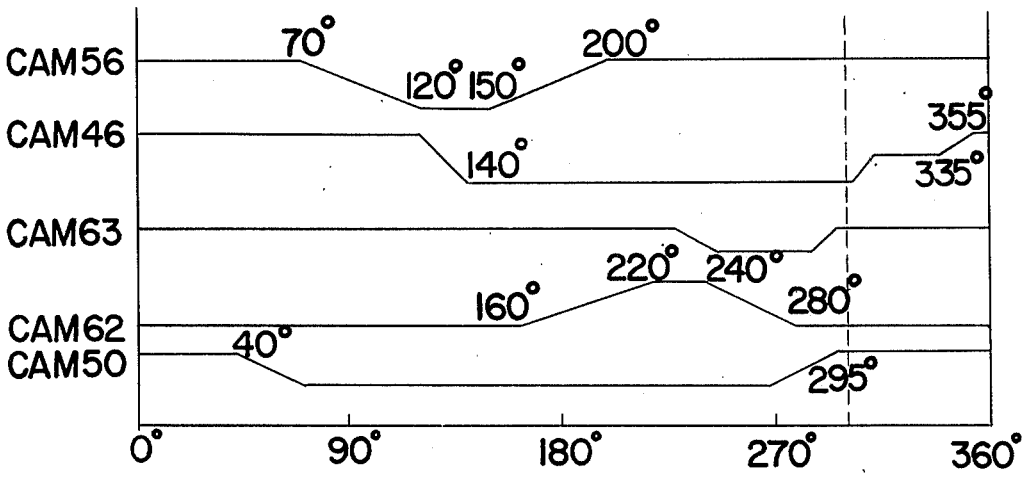
FIG. 15 is a diagram showing respective shapes of various cams which are developed in a plane in relation to the angle of rotation of the shaft supporting these cams.

As shown in FIG. 15, at the time the cam support shaft 42 completes its rotation through approximately 40°, ,the second cam drum 50 becomes condition to move the slidable block 53 towards the operative position, in the manner as hereinbefore described. At the time of approximately 70° rotation of the cam support shaft 42, the slidable block 53 arrives at the operative position with the loop 30*a* on the needle 30 ready to guide the thread end in such a way as to extend between the tailstock 18 and one of the bobbin flanges 1*b* that is located adjacent thereto.

Shortly thereafter or simultaneously therewith, the pivotal lever 16 having the transfer segment 16*a* commences to pivot towards the delivery position from the stand-by position, transferring the front one of the empty bobbins resting on the chute 8 towards the space between the headstock 17 and the tailstock 18. The first cam drum 46 comes to a position to move the spindle 49 and, hence, the tailstock 18 from the release position to the hold position at the same time the pivotal lever 16 arrives at the delivery position, i.e., upon completion of approximately 120° rotation of the cam support shaft 42.

At approximately 140° rotation of the cam support shaft 42, the bobbin is firmly held between the headstock 17 and the tailstock 18 while the thread end is firmly held between the tailstock 18 and one of the bobbin flanges 1*b* thereby being anchored to the empty bobbin. Thereafter, the pivotal lever 16 returns to the stand-by position before the cam support shaft 42 completes its rotation through approximately 200°. During rotation of the cam support shaft 42 from the approximately 160° position to the approximately 280° position, the cam disc 62 is in position to position the detecting lever 23 in the engaged position (if it is not in the engaged position) and to cause the switch assembly 41 to be reset to open (if not opened) and, at the same time, to pivot the detecting lever 23 to the engaged position.

Thereafter, the cam disc 57 on the cam support shaft 42 causes the switch 59 to close at, for example, the 300° rotation position. Closure of the switch 59 results in energization of a relay CR3. It should be noted that a relay switch SW7 associated with a relay CR4 is at this time closed and the relay switch SW3 associated with the relay CR1 is still closed and, therefore, energization of the relay CR3 is possible. This energization of the relay CR3 results in closure of the associated relay switches SW5 and SW6 and, consequently, not only is the relay CR3 maintained in the energized state even if the switch 59 is opened, but also the motor 40 is operated. At the same time, the cam disc 71 causes the switch 72, that has been closed, to be opened to deenergize the relay CR2 and the deenergization of the relay CR2 results in opening of the associated relay switch SW4, thus bringing the motor 43 to an inoperative condition. Therefore, rotation of the cam support shaft 42 is interrupted.

During operation of the motor 40, an actual winding of thread on the empty bobbin held in position between the headstock 17 and the tailstock 18 takes place while the cam support shaft 42 is not rotated. As the bobbin is wound with the thread with the diameter thereof increasing, the detecting lever 23 with the feeler 23*a* in sliding contact with the thread wound on the bobbin pivots towards the disengaged position and, finally, the pin 27 on the intermediate lever 26 disengages from the detent notch 23*b*, at which time the detecting lever 23 arrives at the disengaged position. As the pin 27 on the intermediate lever 26 disengages from the detent notch 23*b* in this way, the switch assembly 41 is closed to stop the operation of the motor 40 in the following manner.

When the detecting lever 23 is moved to the disengaged position in the manner as hereinbefore described, the switch assembly 41 is closed by the roller element 26*b* carried on the intermediate lever 26. Upon closure of the switch assembly 41, a relay CR4 is energized and, therefore, the associated switches SW7 and SW8 are respectively opened and closed. Opening of the relay switch SW7 results in deenergization of the relay CR3 which in turn opens the relay switch SW6, thus bringing the motor 40 to an inoperative condition and, on the other hand, closure of the relay switch SW8 results in energization of the relay CR2 which in turn closes the relay switch SW4 to operate the motor 43.

It has now become clear that the cam support shaft 42 is again rotated and, when the cam support shaft 42 attains the approximately 335° position, the cam drum 46 is in position to move the spindle 49 to the release position with the tailstock 18 moving away from the headstock 17 to release the filled bobbin into the chute 34. Shortly before this has been achieved, the cam disc 63 causes the stop 35 to be brought into a position to hamper travel of the filled bobbin down the chute 34 and subsequently causes the presser piece 36*a* to engage the abutment 37 with that portion of the thread wound on the bobbin held between said presser piece 36*a* and said abutment 37.

A series circuit composed of the relay switch SW1 and the switch 74, which is connected in parallel to the toggle switch TSW, operates the toggle switch TSW is turned off, i.e., opened. More particularly, so long as the toggle switch TSW is turned on, i.e., closed, the switch 74 is repeatedly switched on and off by rotation of the cam disc 73. However, when the toggle switch TSW is turned off and the cam disc 73 has not yet reached the position to turn the switch 74 off, the motor 43 continues to operate with the cam support shaft 42 still rotating. If the cam disc 73 is subsequently brought into position to turn the switch 74 off, the relay CR1 is deenergized to open the relay switch SW2 and, therefore, the relay CR2 is deenergized to open the relay switch SW4 whereby the motor 43 is stopped.

In other words, the switch 74 functions to stop the rotation of the cam support shaft 42 at a predetermined angular position and, for this purpose, the cam disc 73 is designed to switch the switch 74 off each time the cam support shaft 42 completes its 360° rotation, i.e., each time one cycle of operation is completed.

During the subsequent cycle of operation, while the following one of the empty bobbins is subjected to the same process as has been carried out with the front one of the bobbins now filled with the predetermined quantity of the thread and resting in the chute 34, thread severing takes place as the pivotal lever 16 returns to the stand-by position after having been moved to the delivery position for transferring the following bobbin to the thread winding unit. Thereafter, the cam disc 63 causes the stop 35 to disengage from the filled bobbin on the chute 34 and subsequently causes the same to return to a position in readiness for receipt of the following, filled bobbin on the chute 34.

The foregoing sequence of operation of the machine according to the present invention can be achieved by suitably shaping and positioning the related cams with respect to each other.

Figure 10:
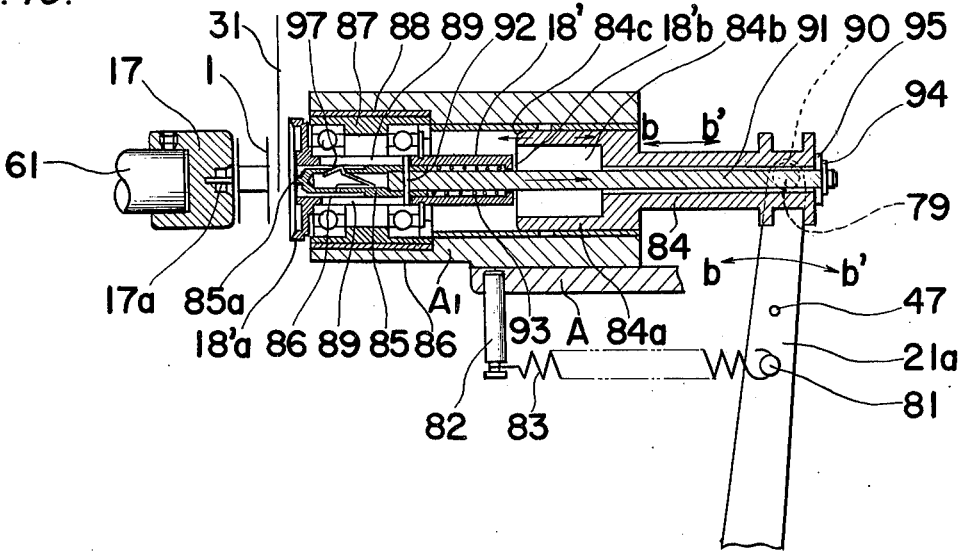
FIG. 10 is a longitudinal sectional view of the axially movable spindle and its support structure shown in FIG.9.
Figure 11:
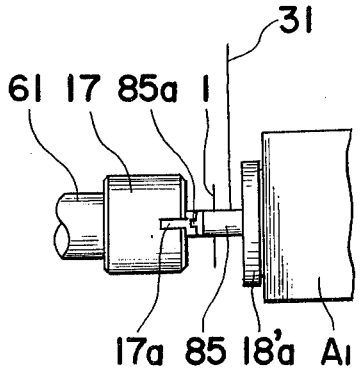
FIGS. 11 (*a*) to (*c*) illustrate a sequence of thread end anchoring with respect to an empty bobbin, which is performed by the axially movable spindle and a cooperating stationary spindle.
Figure 11:
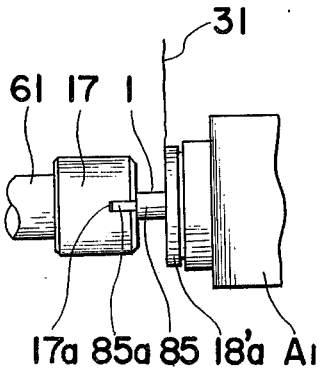
Figure 11:
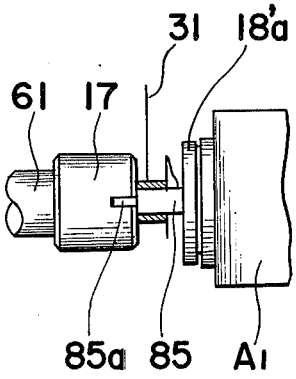
Figure 12:
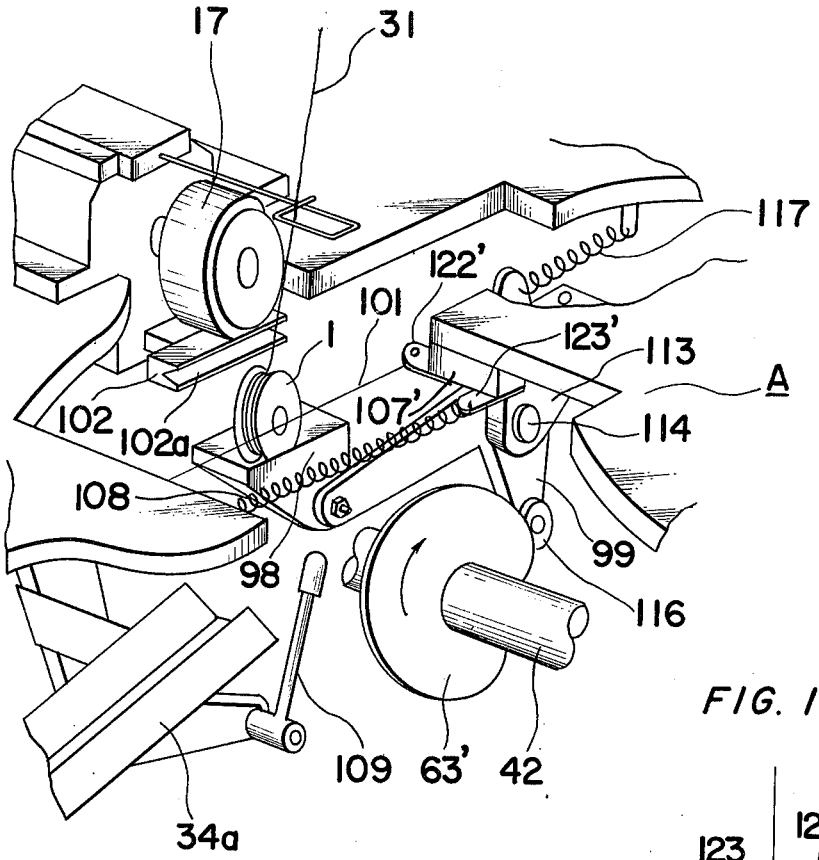
FIG. 12 is a schematic perspective view of a portion of the machine, showing the details of a thread severing unit.
Figure 13:
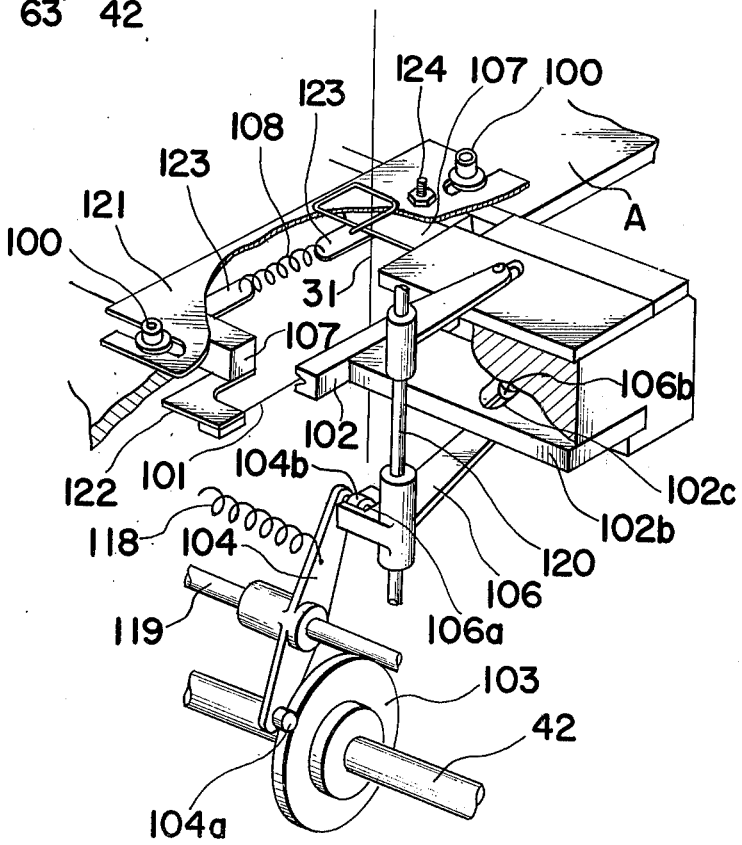
FIG. 13 shows the thread severing unit shown in FIG. 12, but viewed from substantially the opposite direction.
Figure 14:
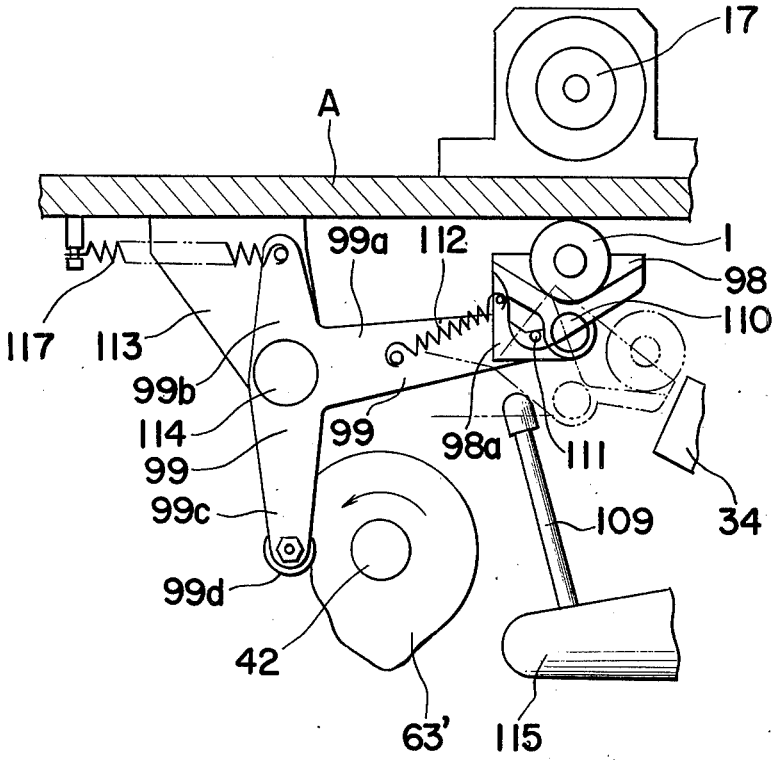
FIG. 14 is a side elevational view of a portion of the machine of the present invention, showing a mechanism for operating the thread severing unit shown in FIGS. 12 and 13.

What is shown in FIGS. 9 to 11 and FIGS. 16 are modifications of the thread winding unit while that shown in FIGS. 12 to 14 is a modification of the thread severing unit including the bobbin temporary storage mechanism.

Figure 9:
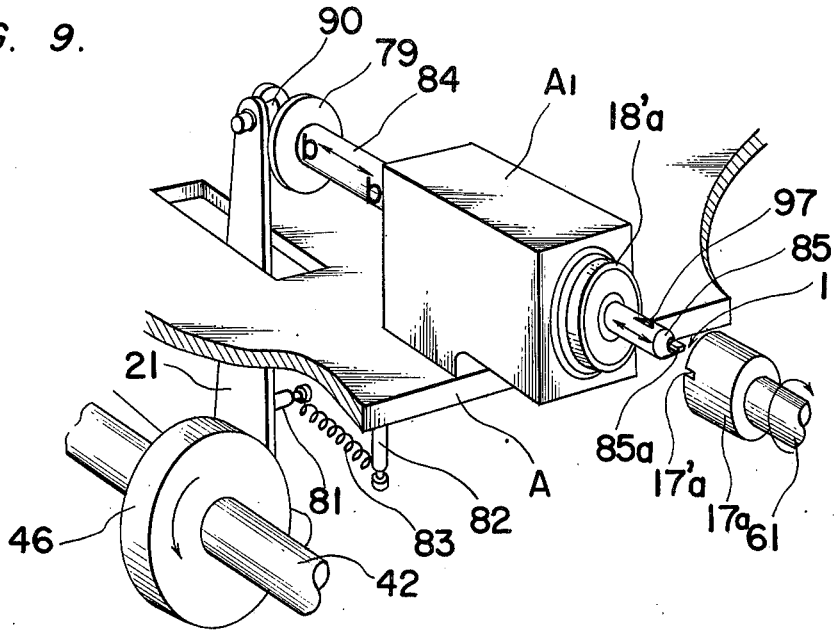
FIG. 9 is a schematic perspective view of an axially movable spindle and its drive mechanism, which are employed in the machine of the present invention.
Figure 16:
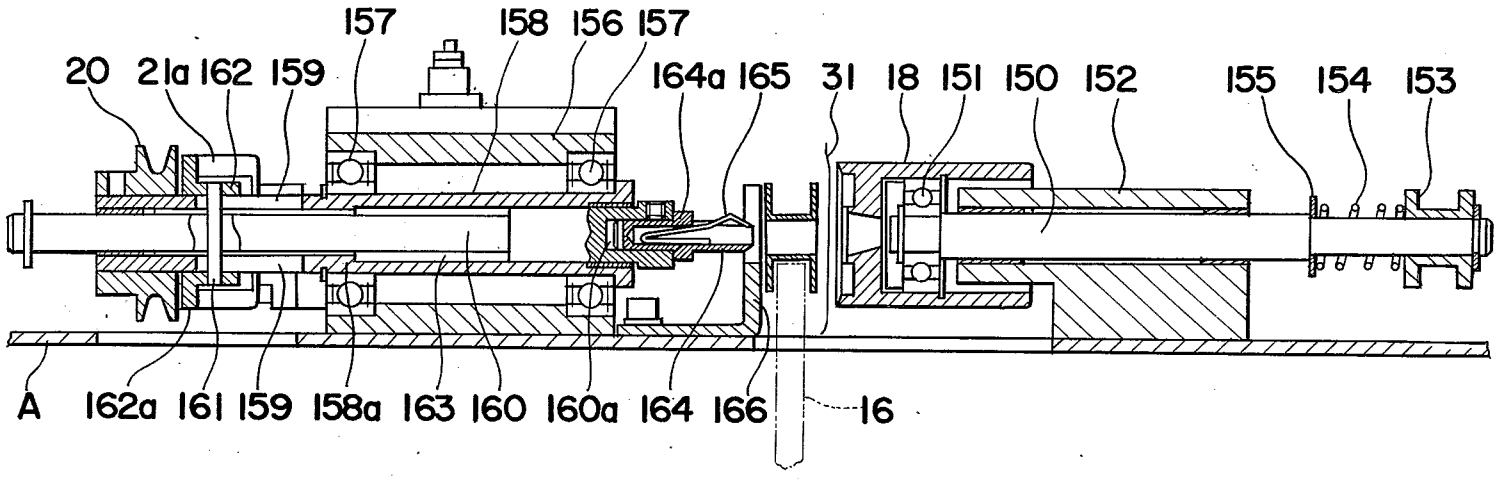
FIG. 16 is a similar view of FIG. 10, showing a modification of the arrangement of a pair of axially movable and stationary spindles.

The modifications of the thread winding unit shown in FIGS. 9 and 10 and FIG. 16, respectively, are designed such as to form each filled bobbin without a leading portion of thread extending from the filled bobbin. In practice, it is found that if the filled bobbin has a leading porition of the thread extending outside the filled bobbin together with a trailing portion thereof which is not hidden during winding, the use of such a filled bobbin in a sewing machine often results in trouble. The modified winding units shown in FIGS. 9 and 10 and FIG. 16 are effective to avoid formation of such an objectionable filled bobbin.

Referring first to FIGS. 9 and 10, the thread winding unit comprises the bearing structure A1 rigidly mounted on the platform A and having a cylindrical hollow formed therein. At one end of the bearing structure A1 and within the cylindrical hollow thereof, a tubular casing 87 carrying therein a pair of spaced ball bearings 86 is axially slidably inserted through a bushing 88 lining, or otherwise pressure-fitted to, the inner wall of the bearing structure Al which defines the cylindrical hollow. The spaced bearings 86 support a tubular body 18' for rotation thereabout and this tubular body 18' extends in alignment with the motor-coupled spindle 61 and has integrally formed on one end a tailstock 18'*a* situated outside the bearing structure Al and at the other end an opening 18'*b*. The tubular body 18' with the tailstock 18'*a* thereon can move in an axial direction together with the tubular casing 87 and can rotate about its own axis independently of the tubular casing.

A hollow shaft 84 extending in alignment with the tubular body 18' has a pair of spaced flanges 79 at one end thereof situated outside the bearing structure Al and at the other end an enlarged stem portion 84*a* which is axially slidably housed within the bearing structure Al. This enlarged stem portion 84*a* has an axially extending cavity 84*b* communicating with the hollow of the shaft 84, but of a greater diameter than the inner diameter of the shaft 84.

The operating lever 21 having one end engaged with the cam drum 46 in the manner as hereinbefore described has mounted on the other end a roller 90 which is engaged in between the opposed flanges 79 on the shaft 84 so that pivotal movement of said operating lever 21 about the pivot 47 can be translated into an axial movement of the shaft 84. It should be noted that, since the spring 22 that has been described as employed in the foregoing embodiment (FIG. 1) is not employed, a tension spring 83 is employed for biasing the operating lever 21 in one direction in such a way as to force the roller element 21*b* on said lever 21 to constantly engage the cam drum 46. For this purpose, the tension spring 83 is suspended between a pin 82, downwardly extending from the platform A, and the operating lever 21.

In the condition as shown in FIG. 10, the hollow shaft 84 is in a disengaged position and, when the operating lever 21 is pivoted against the tension spring 83, the shaft 84 moves towards an engaged position. During travel of the shaft 84 and as it approaches the engaged position, the adjacent end portion of the tubular body 18' is relatively received within the cavity 84*b* and finally engagement between the tubular casing 87 and the annular end 84*c* of the enlarged stem portion 84*a* takes place. Further movement of the shaft 84 towards the engaged position is transmitted to the tubular body 18' through the tubular casing 87 via the bearings 86 and, therefore, the tubular body 18' axially moves thereafter together with the hollow shaft 84. The tailstock 18'*a* carried by the tubular body 18' approaches the headstock 17 and, at the time of arrival of the shaft 84 at the engaged position, is positioned so as to firmly hold the empty bobbin between it and the headstock 17 while the thread 31 extends between said tailstock 18'*a* and the adjacent one of the bobbin flanges 1*b* for thread end anchoring.

Axially slidably and rotatably extending through the hollow of the shaft 84 is a connecting rod 91 having one end situated outside the shaft 84 and having a collar 95 held by means of a washer 94 on said rod 91 and the other end extending through the opening 18'*b* and housed within the tubular body 18'. A hollow spindle 85 of an outer diameter slightly smaller than the inner diameter of the cylindrical body 1*a* of each bobbin 1 is slidably housed within the tubular body 18' and has on one end a projection 85*a* extending across and at right angles to the longitudinal axis of said spindle 85 and has the other end rigidly connected to and mounted on the connecting rod 91. A compression spring 93 is housed within the tubular body 18' between the end of the spindle 85 and that of the tubular body 18' for biasing said spindle 85 and said rod 91 in one direction towards the headstock 17. It should be noted that the axial pushing force exerted by said compression spring 93 on the spindle 85 is smaller than the pulling force exerted by the tension spring 83.

The spindle 85 and the connecting rod 91 are synchroneously rotatable about their own axes when the rotational force of the head-stock 17 is transmitted to the tailstock 18'*a* through the bobbin being wound with the thread 31. For this purpose, a pin 92 extends through the connecting rod 91 and the spindle 85 across and at right angles to the longitudinal axis of said rod 91, both ends of which are engaged and guided in the opposed axial grooves 89 formed in the spindle 18'*a*, whereby rotation of the tubular body 18' can be transmitted both to said spindle 85 and to said connecting rod 91.

Axial movement of the spindle 85 independent of that of the tubular casing 87 is effected by the compression spring 93 if the shaft 84 moves towards the engaged position at which time the collar 95 on the connecting rod 91 follows the shaft 84 and the spindle 85 projects outside the tubular body 18' beyond the tailstock 18'*a*. When the hollow shaft 84 is in the engaged position, the spindle 85 extends through the cylindrical body 1*b* of the bobbin 1 (FIG. 11(*b*)) with the projection 85*a* engaged in a mating groove 17*a* in the headstock 17 while said bobbin 1 is filmly held in position between the headstock 17 and the tailstock 18'*a*.

Figure 18:
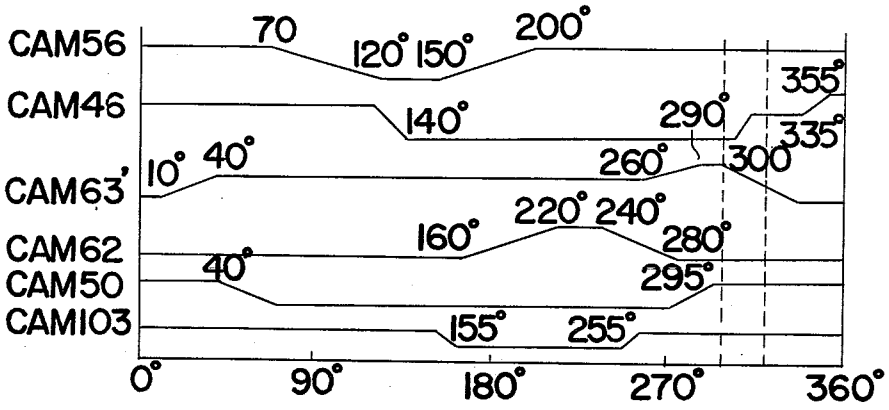
FIG. 18 is a diagram similar to that of FIG. 15.

While in the arrangement as hereinbefore described, the cam drum 46 for the thread winding unit of FIGS. 9 and 10 is preferably designed such that, as shown in FIG. 18, after the shaft 84 has been moved to the engaged position and few layers of the thread 31 have been subsequently wound on the bobbin, the shaft 84 is moved a predetermined distance back towards the disengaged position with the annular end 84*c* disengaging from the tubular casing 84 and, therefore, the tailstock 18'*a* can be retracted to release the thread end that has been sandwiched between the tailstock 18'*a* and the bobbin flange 1*b*. This is possible because, as the shaft 84 moves from the engaged position towards the disengaged position with the annular end 84*c* of the enlarged stem portion 84*a* separating from the tubular casing, the rod 91 is correspondingly moved with the collar 95 in engagement with the end of the shaft 84, this movement of said rod 91 being transmitted to the tubular body 18' through the compression spring 93 without compressing the latter. It should be noted that, even if this takes place, the projection 85*a* at the tip of the spindle 85 does not disengage from the mating groove 17*a* in the headstock 17 because of a length of said projection 85*a*.

For securing the bobbin 1 on the spindle 85 during the winding operation, a substantially V-shaped leaf spring 97 is housed within the spindle 85 and partially exposed to the outside of said spindle 85 for imparting friction to the bobbin when the latter is mounted on said spindle 85.

FIGS. 11(*a*) to 11(*c*) illustrate the sequence of thread end anchoring with the arrangement of FIGS. 9 and 10. FIG. 11(*a*) illustrates the condition that occurs after the shaft 84 has been moved towards the engaged position and before engagement between the annular end 84*c* and the tubular casing 87 takes place. FIG. 11(*b*) illustrates the condition in which the shaft 84 arrives at the engaged position and the tailstock 18'*a* is pushed into position to hold the bobbin between it and the headstock 17. At this time, the leading end of the thread 31 is firmly sandwiched between the tailstock 18'*a* and the bobbin flange 1*b* and the winding operation is thereafter initiated in the manner as hereinbefore described.

Although in the foregoing embodiment an arrangement has been made to turn the switch 59 on to operate the motor 41 and to turn the switch 72 off to bring the motor 43 to the inoperative condition both at the time the winding operation is to be initiated, the switch 72 is, in the example of FIGS. 9 and 10, turned off shortly after the winding operation has been initiated, that is, preferably after a few layers of thread have been wound on the bobbin then being wound. This is possiblmerely by angularly displacing the cam disc 71 about the shaft 42 relative to the position shown in FIG. 1.

By doing so, it is possible to retract, as shown in FIG. 11(*c*), the tailstock 18'*a* away from the adjacent bobbin flange 1*b* during the early period of the winding operation in the manner as hereinbefore described. After the tailstock 18'*a* has been thus retracted while the spindle 85 is still in position with the projection 85*a* engaged in the mating groove 17*a* in the headstock 17 and the bobbin is on said spindle 85, the leading end of the thread 31 that has been sandwiched between the tailstock 18'*a* and the bobbin flange is released and, during continued rotation of the bobbin, is entangled in subsequently formed layers of the thread on the bobbin.

Therefore, it is clear that the finished bobbin has no thread end exposed outside the bobbin except for the trailing end thereof that has separated from the thread extending from the supply cone 75.

In the example shown in FIG. 16, the tailstock 18 is rotatably mounted by a bearing 151 on a shaft 150 which axially slidably extends through a bearing block 152 rigidly mounted on the platform A. This shaft 150 having the tailstock 18 mounted on one end has the other end journalled in a bearing block 153 and has a compression spring 154 between said bearing block 153 and an axially non-movable collar 155 for cushioning the shaft 150.

Rigidly mounted on the platform A in opposition to the tailstock 18 is a bearing structure 156 having therein a pair of spaced bearings 157 which rotatably, but axially non-movably, carry a quill 158. The quill 158 has rigidly mounted on one end a pulley 20 coupled to the motor 40 through the belt 19 and has formed therein at 159 a pair of opposed axial grooves.

The quill 158 has a hollow, a half of this quill hollow being enlarged to provide an annular step as at 158*a*, and axially slidably accommodates therein a spindle structure 160 having a construction as will be hereinafter described.

The spindle structure 160 has one end portion provided with a pin 161, which extends therethrough across and at right angles to the longitudinal axis thereof, both ends of which extend through the axial grooves 159 and are connected to a flanged sleeve 162, and the other end portion is enlarged and has an axially inwardly extending cavity 160*a*. This spindle structure 160 is biased in one direction by a compression spring 163 mounted on said spindle structure 160 between the step 158*a* and the enlarged end portion of said spindle structure 160. However, this compression spring 163 exerts an axial pushing force smaller than the spring element, for example, the tension spring 83 in the example of FIGS. 9 and 10, used to bias the operating lever 21 and, accordingly, said spindle structure 160 is normally held in the release position.

A tubular spindle 164 having one end closed and the other end tapered in non-detachably inserted into the cavity 160*a* and has an annular flange or headstock 164*a* formed on the outer periphery thereof. A substantially V-shaped leaf spring 165 is housed within said spindle 164 and is partially exposed to the outside of said spindle 164 for imparting friction to the bobbin 1 when the latter is mounted thereon.

Axial movement of the spindle structure 160 towards the hold position to hold the empty bobbin between the headstock 164*a* and the tailstock 18 is effected by the compression spring 163 as the double fork 21*a* of the operating lever 21 tends to move away from the flange 162*a* of the flanged sleeve 162. Rotation of the spindle structure 160 is caused by rotation of the quill 158 which is transmitted thereto through the pin 161.

The thread winding unit having the construction shown in FIG. 16 performs a thread anchoring method similar to that performed by the arrangement of FIGS. 9 and 10, that is, as shown in FIGS. 11(*a*) to 11(*c*). However, while in the arrangement of FIGS. 9 and 10 removal of the filled bobbin from the spindle takes place as the spindle 85 completely retracts within the tubular body 18', in the arrangement of FIG. 16, such removal is effected by a substantially Y-shaped ejector 166, rigidly mounted on the platform A and having a pair of upwardly extending forks spaced apart slightly greater than the diameter of the headstock 164*a*, as the spindle structure 160 moves towards the release position.

It should be noted that the provision of the compression spring 154 enables the thread winding unit of FIG. 16 to accommodate bobbins of different sizes between the headstock 164*a* and the tailstock 18.

Figure 7:
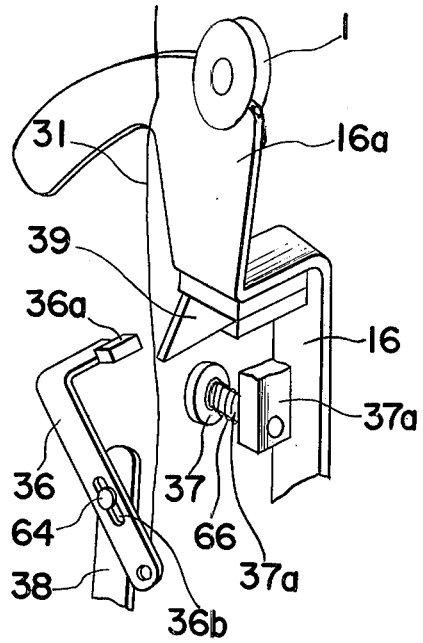
FIG. 7 is a schematic perspective view of a portion of a shuttling mechanism and a thread severing unit associated therewith.

Referring now to FIGS. 12 to 14, the modified version of the thread severing unit employs a burner heater element 101 in place of the cutter blade that has been described as employed in the foregoing embodiment of FIGS. 1 and 7. In addition, the temporary storage mechanism employed in the modified version of the thread severing unit shown includes a bucket 98 in place of the stop 35 (FIG. 8) and its associated operating mechanism.

Referring particularly to FIG. 13, the burner heater element 101 is suspended between a pair of spaced terminal members 122, said terminal members 122 being rigidly secured to insulating pieces 107, made of electrically insulating material, which are in turn pivotally carried by a plate member 121 such as by the use of bolts and nuts 124, respectively, in spaced relation with respect to each other. At the other end of the terminal members 107, a tension spring 108 is suspended therebetween to hold the burner heater element 101 under tension whenever said burner heater element 101 is energized or operated.

The plate member 121 carrying the burner heater element 101 in this way is mounted on the platform A and detechably secured in position by means of a plurality of set screws 100 in such a way as to cause the burner heater element 101 to extend at right angles to the direction of movement of the tailstock toward and away from the headstock (or, at right angles to the direction of movement of the headstock toward and away from the tailstock, in the case where the thread winding unit is in the form as shown in FIG. 16).

Cooperative with this burner heater element 101 is a presser 102 having therein a substantially V-sectioned groove 102*a* which extends parallel to the heater element 101 and is adapted to receive therein said heater element 101 to ensure an exact burning of the thread 31 for cutting purposes. In other words, the presser 102 acts to force a portion of the thread to be cut to contact said heater element 101 when the cutting is to be performed.

In order to achieve this, the presser 102 is carried by a slidable plate 102*b* slidably supported by a bearing block for supporting the tailstock 17 (or, headstock 164*a* in the arrangement of FIG. 16), or otherwise by the platform for movement toward and away from the heater element 101. This movement of the slidable plate 102*b* is effected by a cam disc 103 rigidly mounted on the cam support shaft 42 in a manner as will be described.

A shaft 119 is supported in position within the space between the platform A and the base C in any suitable manner and has rotatably mounted thereon a transmission lever 104. The transmission lever 104 has mounted on both ends roller elements 104*a* and 104*b* and is normally biased in one direction about the shaft 119 with the roller element 104*a* constantly engaged with the cam periphery of said cam disc 103. Adjacent the roller element 104*b* on the transmission lever 104, a shaft 120 extends at right angles to the shaft 119, both ends of which are journalled respectively on the platform A and the base C, and carries an intermediate lever 106 rotatably, but axially non-movably, mounted thereon. This intermediate lever 106 has formed therein as at 106*a* a guide groove of channel section and of a size sufficient to accommodate therein the roller element 104*b*, and also has at 106*b* an upright pin engaged in a slot 102*c* formed in the slidable plate 102*b*, said guide groove 106*a* extending parallel to the lengthwise direction of the shaft 120 and said slot 102*c* extending at right angles to the direction of movement of the plate 102*b*.

From the foregoing, it has now become clear that the pivotal movement of the transmission lever 104 can be translated into a linear movement of the slidable plate 102*b*. The cam disc 103 is preferably designed, as shown in FIG. 18, such that the slidable plate 102*b* can be moved close to the heater element 101 when and after the filled bobbin has been released from the winding unit onto the temporary storage mechanism, which may be in the form of the chute 34 in combination with the stop 35 or which may be the bucket 98 as will be hereinafter described.

Referring to FIGS. 12 and 14, the bucket 98 is pivotally supported on a mounting lever 99 of substantially T-shape having three end portions 99*a*, 99*b* and 99*c*. The mounting lever 99 is, at the junction of these end portions 99*a*, 99*b* and 99*c*, pivotally secured by a set pin 114 to a bracket 113 extending from the platform A and is biased in one direction about the pin 114 by a tension spring 117 suspended between the end portion 99*b* and the platform A in such a way as to constantly engage a roller element 99*d* on the end portion 99*c* with the cammed periphery of a cam disc 63′ on the cam support shaft 42. The end portion 99*a* carries the bucket 98 at the tip thereof which bucket is mounted thereon by a mounting pin 110 for pivotal movement about said pin 110 between a receiving position and a delivery position. The bucket 98 is normally biased in one direction by a tension spring 112, suspended between said end portion 99*a* and said bucket 98, to the bobbin receiving position in readiness for receipt of the filled bobbin that will be released from the thread winding unit positioned thereabove. It should be noted that a stop 111 is provided on the end portion 99*a* for holding the bucket 98, biased by the tension spring 112, in the receiving position.

Positioned below the bucket 98 is a stop rod 109 rigidly carried by a support 115, which may be rigidly mounted on the base C, the tip of which stop rod 109 is engageable with a portion, as at 98*a*, of the bucket 98 for pivoting the bucket 98 about the pin 110 to the delivery position.

In the arrangement so far described, as the cam disc 63′ rotates together with the shaft 42, the mounting lever 99 pivots about the pin 114 in one direction against the tension spring 117. At this time, the bucket 98 with the filled bobbin 1 thereon is lowered while it still is in the receiving position, whereby a portion of the thread 31 that extends between the bobbin on the bucket 98 and the tension control 32 can be stretched. Further rotation of the cam disc 63′ and, hence, further pivotal movement of the lever 99 against the spring 117, causes the tip of the stop rod 109 to abut against the portion 98*a* of the bucket 98, thus pivoting the bucket 98 about the pin 110 from the receiving position to the delivery position as indicated by the chain line in FIG. 14, at which time the filled bobbin on the bucket 98 is rolled by gravity into the chute 34 leading to the storage receptacle 2.

Referring to FIG. 18, the cam disc 63′ is designed as follows: From the approximately 340° position of the cam support shaft 42 during one cycle of operation to the approximately 10° position thereof during the subsequent cycle, the lever 99 is positioned as shown in FIG. 14 with the bucket 98 in the receiving position. From the approximately 10° position to the approximately 40° position, the lever 99 is, after the filled bobbin 1 has been dropped into the bucket 98, pivoted against the tension spring 117 to stretch that portion of the thread between the bobbin 1 on the bucket 98 and the tension control 32. During this period, the pressure 102 approaches the heater element 101 in the manner as hereinbefore described with that portion of the thread 31 held between said heater element 101 and said presser 102 so that said portion of the thread is burned, or cut. Thereafter and upon arrival of the cam support shaft 42 at the approximately 290° position, the bucket 98 assumes the delivery position to doff the filled bobbin from said bucket 98 into said chute 34.

From the foregoing full description of the present invention, it has now become clear that the machine is effective to automatically wind a predetermined quantity of thread on empty bobbins one at a time. However, it should be noted that various changes and modifications are apparent to those skilled in the art. By way of example, it should be understood that each of the tailstock and headstock is lined, or otherwise provided, with a holding piece, made of material of high frictional coefficient such as rubber, for avoiding a relative slippage between it and the bobbin flange. In addition, as shown in FIG. 1, a thread smoothing device 76 which is supported on a support plate 33 on the platform A and which is substantially made of a zig-zag wire, may be employed. Furthermore, the machine may be mounted on a caster-wheeled bench.

Accordingly, these changes and modifications should be understood as included within the scope of the present invention unless otherwise they depart therefrom.

What is claimed is:

1. An automatic thread winding apparatus for successively winding thread on double-flanged bobbins, which comprises in combination:

a bevel-shaped dish for arbitrarily receiving a plurality of the bobbins therein, said bevel-shaped dish being rotatably supported in a horizontal position, rotating means coupled to said dish for continuously rotating said dish in one direction, a guide wall extending fixed in position slightly above said dish and around a part of the circumference of the dish slightly inwardly of the periphery of the dish, and a wire guide fixed in position around and just above the peripheral edge of said dish;

winding means including a pair of axially aligned first and second holding means for firmly holding each one of the empty bobbins in a winding position between said first and second holding means in readiness for winding operation;

a pair of spaced parallel wires, one extending from said wire guide and the other from an end of said guide wall adjacent the periphery of said bevel-shaped dish, said spaced parallel wires extending to a position adjacent to and spaced from said winding position;

said guide wall and said guide wire guiding the bobbins placed on said dish towards and onto said spaced parallel wires during rotation of said dish;

a guide block supported in position at said position adjacent to and spaced from said winding position and including a bobbin passage formed therein, said spaced parallel wires being coupled to said guide block at one end of said bobbin passage;

a bobbin transfer member supported in position for pivotal movement between first and second positions, said bobbin transfer member having a bobbin receiving seat which is aligned with the other end of said bobbin passage in said guide block when said transfer member is in said first position and is brought to said winding position when said transfer member is in said second position, said bobbin transfer member further having a portion therein which moves past said other end of said bobbin passage in said guide block during pivotal movement of said transfer member between said first and second positions for blocking the movement of the next bobbin on said bobbin passage from falling out of said bobbin passage;

thread anchoring means adjacent said holding means for anchoring the thread to the bobbin that is held in position between said holding means;

first means operatively coupled to one of said holding means for rotating said one of said holding means;

second means operatively associated with one of said holding means for axially moving said one of said holding means which is associated therewith, said one of said holding means associated with said second means being moved close to the other of said holding means for first tightly holding each bobbin that has been transferred by said bobbin transfer means onto said winding means in position between said holding means and then withdrawing slightly from the transferred bobbin, said axially movable holding means having an axially retractable mounting spindle carried thereby for axial movement in a direction aligned with the holding means independent of the axial movement of said axially movable holding means, and being inserted into the center of the transferred bobbin during movement of the axially movable holding means toward the bobbin and remaining within said bobbin during said slight withdrawing movement, and said each bobbin and said holding means of said pair being synchronously rotated by said first means through said one of said holding means which is coupled with said rotating means, thereby winding the thread thereon;

detecting means adjacent said holding means and coupled to said rotating means for detecting whether or not the bobbin has had a predetermined quantity of thread wound thereon and for interrupting operation of said rotating means upon attainment of the predetermined quantity;

doffing means coupled to said holding means and operable upon completion of the winding operation for axially moving said one of said holding means to release the full bobbin, said doffing means including a severing means for severing the thread to separate the thread wound on the bobbin from that leading from a thread supply device; and a storage receptacle beneath said doffing means for receiving the filled bobbins after the severing operation has been completed; and temporary storage means positioned below said winding means and between said winding means and said storage receptacle and substantially adjacent to said severing means for receiving the full bobbin from said holding means under the effect of gravity and temporarily storing the filled bobbin therein to assist said severing means, and for ejecting the filled bobbin into said storage receptable after said severing operation is completed.

2. An apparatus as claimed in claim 1, wherein said anchoring means comprises a block supported for sliding movement parallel to the holding means between operative and inoperative positions and a needle having one end secured to said block and the other end in the shape of a loop positioned substantially above said holding means and through which the thread extends, said loop, when said block is in said inoperative position, being situated immediately above the bobbin, and when said block is in the operative position and when said axially movable holding means is moved away from the other holding means, being situated immediately above the space between said axially movable holding means and the bobbin that is positioned in said winding means, whereby the thread end is anchored to the bobbin when said axially movable holding means moves close to the other holding means to hold the bobbin in position between said holding means.

3. An apparatus as claimed in claim 1, wherein at least one of said first and second holding means is provided with means for adjusting the space between said first and second holding means for facilitating accommodation of bobbins of different sizes within the space between said first and second holding means.

4. An apparatus as claimed in claim 1, wherein at least one of said first and second holding means is provided with a centering device for centering the bobbin, that has been transferred to the winding means, with respect to both of said holding means.

5. An apparatus as claimed in claim 1, wherein said severing means comprises an electrical burner heater element, means for pressing a portion of the thread wound on the bobbin adjacent said bobbin towards said heater element and means for adjusting a contact pressure exerted between said heater element and said pressing means through said portion of said thread.

6. An apparatus as claimed in claim 5, wherein said heater element and said pressing means are in a single unit for facilitating installation of said heater element and said pressing means on the apparatus.

7. An apparatus as claimed in claim 1, wherein said severing means comprises a cutter blade secured to said transfer member whereby thread severing can be performed in response to movement of said transfer member.

8. An apparatus as claimed in claim 1, wherein said temporary storage means comprises a pivotally supported bucket and means for pivoting said bucket for doffing the bobbin, that has been received in said bucket during the severing operation, into said storage receptacle.

9. An apparatus as claimed in claim 1, wherein said temporary storage means is in the form of a chute.

* * * * *